United States Patent [19]

Huiskes

[11] 4,052,932

[45] Oct. 11, 1977

[54] FOLDING MACHINE FOR BOX BLANKS

[75] Inventor: Johannus Martinus Huiskes, Borne, Netherlands

[73] Assignee: Koppers Company, Inc., Pittsburgh, Pa.

[21] Appl. No.: 674,293

[22] Filed: Apr. 6, 1976

[30] Foreign Application Priority Data

Apr. 1, 1975 Netherlands ..... 7503837

[51] Int. Cl.[2] ..... F01B 19/00

[52] U.S. Cl. ..... 93/49 R; 93/51 R

[58] Field of Search ..... 93/49 R, 52, 51 R

[56] References Cited

U.S. PATENT DOCUMENTS

| | | | |
|---|---|---|---|
| 2,911,889 | 11/1959 | Welsh | 93/52 X |
| 3,097,576 | 7/1963 | Borke | 93/49 R |
| 3,122,068 | 2/1964 | Dunn | 93/51 R |
| 3,122,069 | 2/1964 | Lopez | 93/52 |
| 3,672,266 | 6/1972 | Klapp | 93/49 R |
| 3,901,134 | 8/1975 | Reizenstein et al. | 93/49 R X |
| 3,902,407 | 9/1975 | Trosdorff | 93/49 R |
| 3,964,374 | 6/1976 | Stolkin et al. | 93/49 R X |

*Primary Examiner*—Roy Lake
*Assistant Examiner*—Paul A. Bell
*Attorney, Agent, or Firm*—Thomas L. Sivak; Oscar B. Brumback

[57] ABSTRACT

A folding machine for folding the front and rear panels of a box blank prior to folding the lateral panels thereof including a pair of pull rolls for advancing successive ones of such blanks, pivotable rising fingers just beyond the pull rolls for initiating upward folding of the front panel along a transverse score line in the blank, a folding beam for intercepting the partially folded front panel of the blank and bending it backward against the body portion of the blank as it continues to advance, a second pair of pull rolls downstream from the folding beam for advancing the partially folded blank and pressing the front panel against the body of the blank, a pivotable stop downstream from the second pair of pull rolls for momentarily stopping advancement of the blank, a second folding beam just downstream from the second pair of pull rolls for supporting the rear panel of the blank to be folded, and a rotatable roller lever adjacent the second folding beam for pushing the body of the blank downwardly against an endless conveyor to cause the rear panel to fold upwardly along a transverse score line in the blank, all being arranged so that the forward folded panel of the next successive blank engages the partially folded upstanding rear panel of the first blank to complete folding thereof against the body of the first blank and thereafter, the pivotable stop being arranged to release the first blank for further advancement and to stop the advance of the second blank for folding of its rear panel.

11 Claims, 5 Drawing Figures

FOLDING MACHINE FOR BOX BLANKS

BACKGROUND OF THE INVENTION

1. Field of the Invention

This invention relates generally to paper manufactures and more specifically to box machines for folding paperboard blanks.

2. Description of the Prior Art

Most box blank folding machines are adapted to fold the side panels of advancing box blanks. An example of one type folder for this purpose is found in J. P. Lopez U.S. Pat. No. 3,122,069 issued Feb. 25, 1964. However, certain box blanks, for example, those to be made into folded trays, require folding of the front and rear panels before the side panels are folded. This presents particular problems since folding of the front and rear panels occurs transverse to the path of advance of the blanks. Known folders of the latter type require a plurality of adjustment to suit the particular proportions of the blanks being folded and usually include folding hooks of some sort to fold the front and rear panels of the blanks.

Accordingly, an object of the present invention generally is to provide an improved folder for folding the front and rear panels of a succession of box blanks and, more particularly, to provide a folder which requires little if any adjustment to accommodate blanks of different sizes and, further, to provide a folder in which no folding hooks are required for folding the panels.

SUMMARY OF THE INVENTION

The foregoing and other objects and novel features are generally accomplished by an apparatus for folding the front and rear panels of a succession of advancing box blanks including a pair of pull rolls for serially advancing the blanks, a movable folding means, such a pivotally mounted fingers, downstream from the pull rolls for partially folding the front panel of a blank upwardly along a transverse score line in the blank, a rigid folding means downstream from the movable folding means for engaging the partially folded front panel and pushing it backward toward the body of the blank while the pull rolls continue to advance the blank, another set of pull rolls downstream from the rigid folding means for continuing advancement of the blank and to press the folded front panel firmly against the body portion of the blank, a stop means downstream from the second pull rolls for momentarily stopping the advance of the blank by engaging the front folded line of the blank, another rigid folding means adjacent the downstream side of the second pull rolls for supporting the unfolded rear panel of the blank, while the blank is stopped by the stop means, above an endless conveyor positioned below the rigid folding means, and another movable folding means, such as a rotatable roller lever, which engages the body portion of the blank adjacent another score line defining the rear panel to urge the body portion of the blank downward against the conveyor to fold the rear panel upwardly by virtue of its engagement with the rigid folding means, such rear panel being folded forward and downwardly against the body portion of the blank by the folded leading edge of the next successive blank coming into contact with the upstanding rear panel of the first blank, the aforementioned stop means releasing the first blank, after the rear blank of the panel is folded, for further advancement along the conveyor.

The above and further objects and novel features of the invention will appear more fully from the following detailed description when the same is read in connection with the accompanying drawings. It is to be expressly understood, however, that the drawings are not intended as a definition of the invention but are for the purpose of illustration only.

BRIEF DESCRIPTION OF THE DRAWINGS

In the drawings wherein like parts are marked alike.

DESCRIPTION OF THE PREFERRED EMBODIMENT

Figure 1:
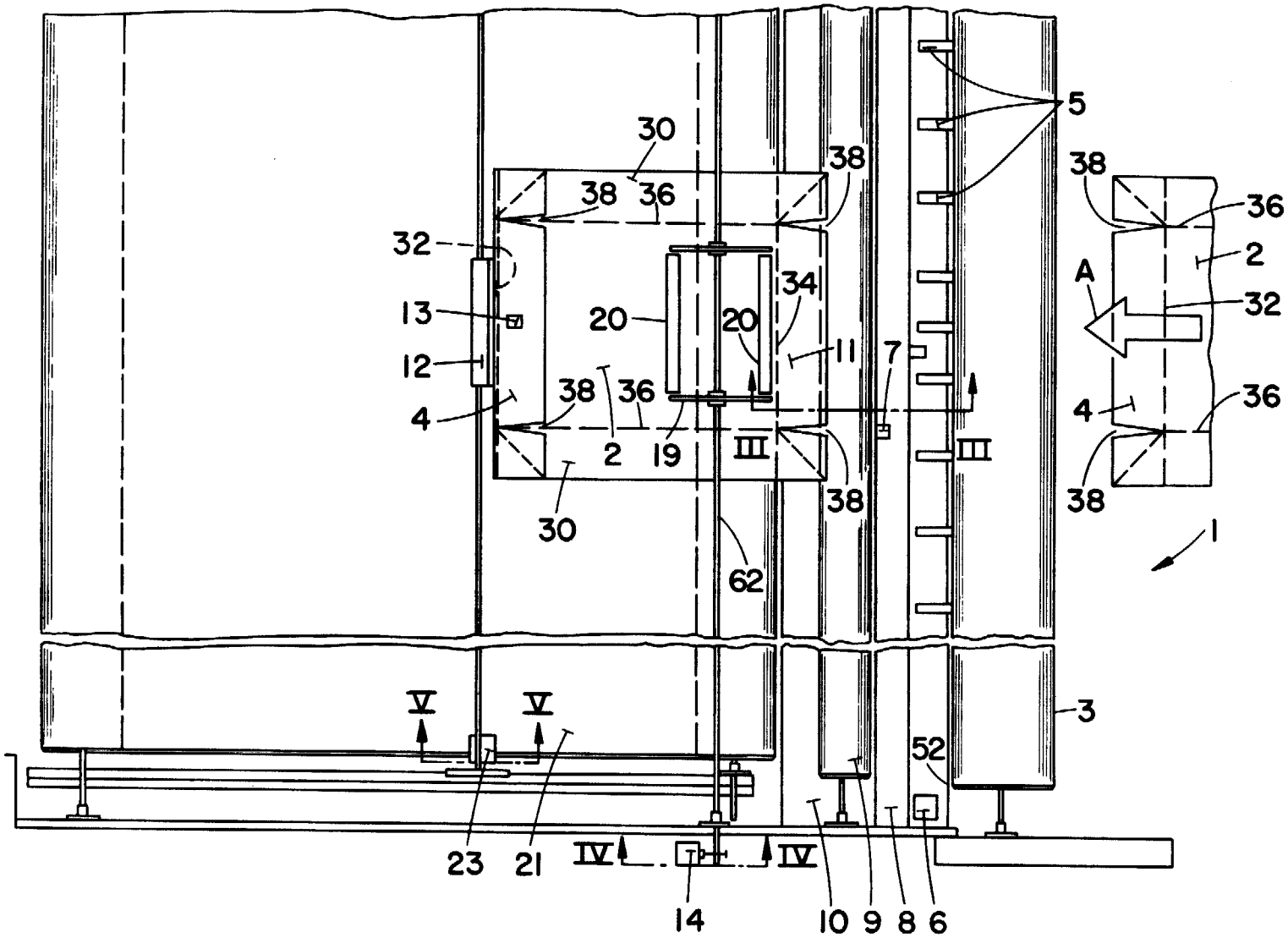
FIG. 1 is a plan view of the folding apparatus of the present invention showing the main elements thereof and a box blank of which the front panel has been folded and just prior to folding of the rear panel.

The blank to be folded is shown in top plan view in FIG. 1 and includes a main body portion 2, a front panel 4, a rear panel 11, and side panels 30. The front panel 4 is defined by folding line 32; rear panel 11 is defined by a folding line 34; and the side panels 30 are defined by folding lines 36. Folding lines 32, 34 and 36 comprise creased or scored lines made in the blank by conventional equipment prior to the blank entering the machine of the present invention and assure that the panels will be folded evenly. The previously formed slots or notches 38 permit the side panels to be folded on top of the folded front and rear panels by subsequent folding machinery such as shown in the previously mentioned Lopez patent; they also permit the corners of the panels to be interlocked by the user when the blank is erected to form a tray as well understood by those skilled in the art.

Figures 2, 3:
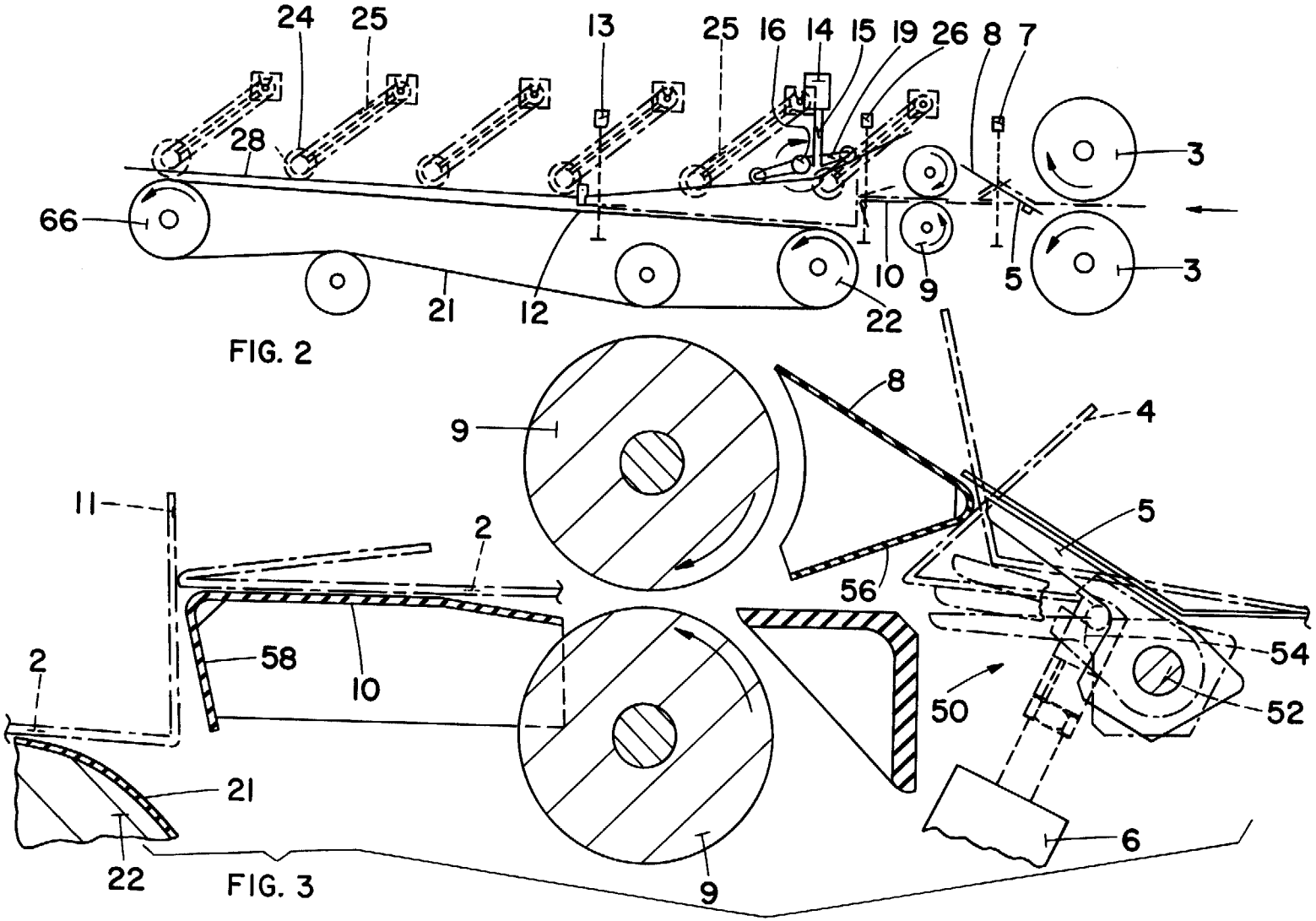
FIG. 2 is a schematic illustration in side elevation of the apparatus of FIG. 1.
FIG. 3 is an enlarged side elevation of the front panel folding portion of the apparatus taken along the lines III—III of FIG. 1 also showing in dotted lines the folding of the front panel of one blank and the rear panel of another.

Referring now to FIGS. 2 and 3, the blank 2 is advanced between a first pair of cooperating pull rolls 3 by a conventional feeding unit (not shown) in the direction of arrow A. As the front panel 4 passes between the pull rolls 3, it is engaged by a first movable folding means generally denoted by numeral 50 actuated by a lifting cylinder 6, such folding means directing the front panel 4 upwardly in the direction of movement of the blank 2 so as to initially bend the front panel 4 about the folding line 32 as shown by the solid lines in FIG. 3. As the blank continues to advance, a sensing means, such as a photocell 7, sends the signal to the lifting cylinder 6 which returns the movable folding means to its original position as shown by the dotted lines in FIG. 3. As the blank continues to advance, the front panel 4 is engaged by a first rigid folding member 8 downstream from the movable folding means 50 which pushes the panel 4 in the direction of the top face of the blank 2 such that the folding line 32 is beneath a lower portion of the rigid folding member 8. As the blank continues to advance, the front panel 4 is bent downward by the lower portion of the rigid folding member 8 and the blank continues onward between a second pair of pull rolls 9 which serve to continue the advance of the blank and to fold the front panel 4 completely flat against the top surface of the body portion of the blank 2. The blank continues moving forward over another rigid folding member 10, just downstream from the second set of pull rolls 9, until the rear folding panel 11 lies on top of the second folding member 10 with the folding line 34 just beyond the downstream edge of the folding member 10. At this time, the leading edge of the blank, which now comprises the front folding line 32, has reached a movable stop means 12 further downstream, as shown in FIGS. 1 and 2, which stops further advance of the blank.

Figure 4:
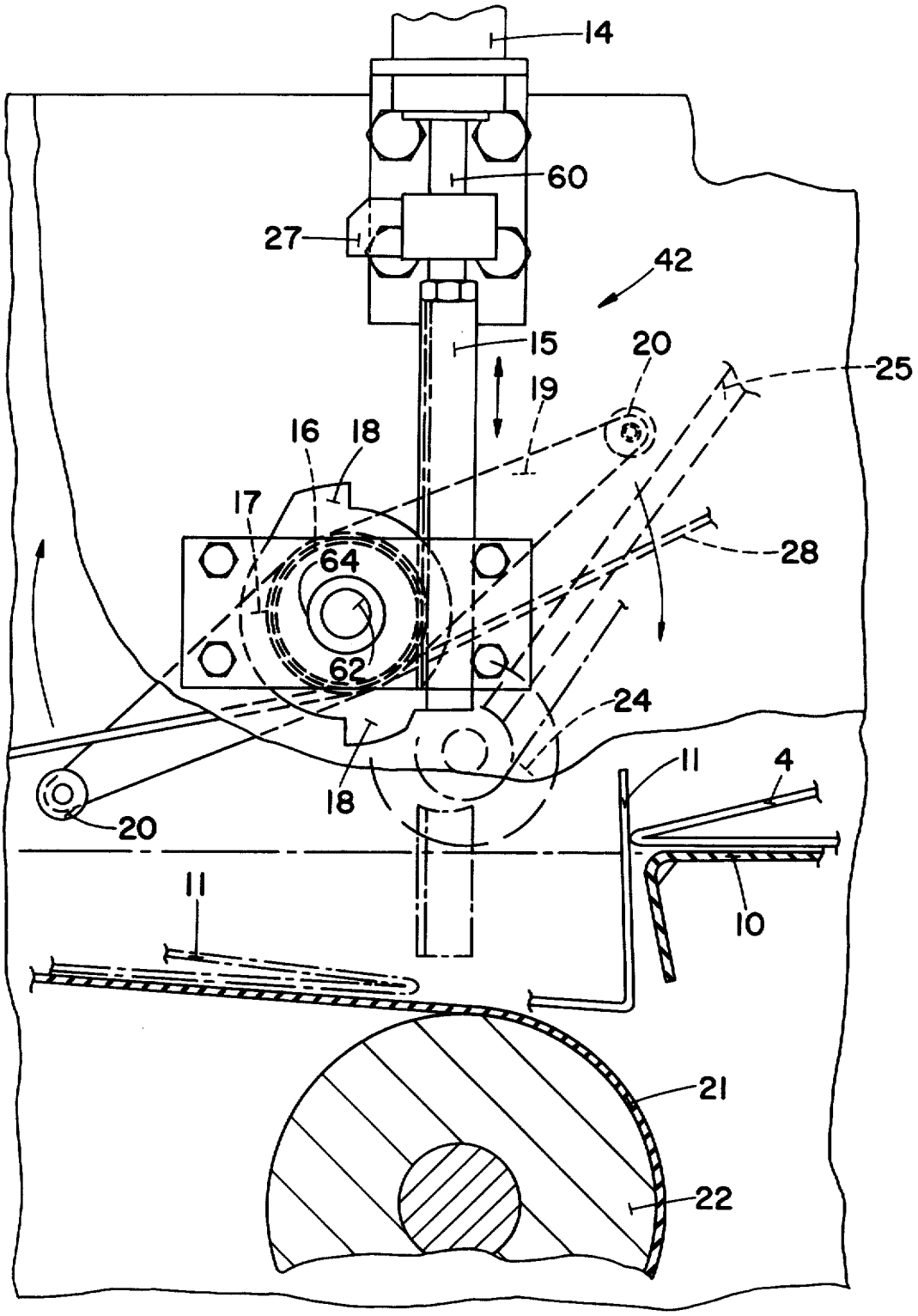
FIG. 4 is an enlarged side elevation of a portion of the apparatus taken along the lines IV—IV of FIG. 2 showing the arrangement for actuating the movable folding means to begin folding of the rear panel of a blank.

Upon reaching the stop means 12, a conventional photocell 13 senses the position of the blank 2 and signals a second movable folding means, generally denoted by numeral 42 in FIG. 4, to rotate so as to engage the body portion 2 of the blank with the rear panel 11 resting on the rigid folding member 10. The body portion of the blank is pushed downward, by rotation of the movable folding means 42, against the top of an endless conveyor 21 but, since the rear panel 11 is supported on the rigid folding member 10, the result is that the rear panel 11 is folded upwardly about folding line 34 as shown by the dotted lines on the left side of FIG. 3. At this time, the next succeeding blank is advancing with its front panel already folded so that its leading edge engages the upstanding rear panel 11 of the first blank thereby bending the panel 11 forward and downward toward the body portion 2 of the first blank. As panel 11 is folded downward, the stop means 12 is caused to release the first blank, by means of a conventional photocell 26 sensing the engagement of the succeeding blank with the upstanding rear panel 11, for continued advancement along the conveyor 21. The first and succeeding blank advance together along the conveyor 21 but the first blank will be drawn away faster than the succeeding blank is advancing since the speed of the succeeding blank is still under the control of the pull rolls 9, the conveyor 21 being arranged to run faster than the pull rolls 9. Thus, as the trailing edge of the front blank clears the stop means 12, the stop will engage the leading edge of the succeeding blank to halt its forward progress while its rear panel is being folded as previously described for the first blank. In this manner, the front and rear panels of the succession of blanks are folded.

A plurality of conventional pressure wheels 24 are supported by pivotable members 25 above the conveyor 21 so as to keep the folded blanks 2 pressed against the top of the conveyor. The pressure wheels are spaced across the width of the conveyor 21 and one or more guide strips 28 are secured between them, as best shown in FIG. 2, to keep the front and rear panels 4 and 11 pressed against the body portion 2 of the blanks as they advance along conveyor 21 and into subsequent machinery such as the side panel folder previously mentioned.

Referring back to FIG. 3, the first movable folding means 50 preferably comprises a plurality of finger members 5 spaced laterally along a shaft 52 extending across the machine as also shown in FIG. 1. The fingers 5 are secured to the shaft 52 so that upon partial rotation of the shaft, the fingers pivot upwardly from the horizontal position shown in dotted lines in FIG. 3 to the inclined position shown in solid lines. The lifting cylinder 6, which may be a conventional hydraulic or pneumatic cylinder, is connected by a conventional clevis connection 54 to one end of the shaft 52 so that the fingers 5 are pivoted upward by extension of the cylinder and pivoted downward by retraction of the cyliner. The cylinder 6 is caused to extend by an electric signal from the photocell 7 sensing the presence of blank 2 advancing across the tops of the fingers 5, the signal being so timed that the cylinder 6 retracts when the leading edge of panel 4 reaches its solid line position in FIG. 3. Thereafter the panel 4 is automatically folded further upwardly by its engagement with the rigid folding member 8.

The first rigid folding member 8 is a rigid beam shaped as shown in FIG. 3 and includes a downwardly inclined lower leg 56 that serves to fold the upstanding panel 4 backward and downward against the body portion 2 of the blank as the blank continues to be advanced by the first pair of pull rolls 3. The blank then advances between the second pair of pull rolls 9 which press the folded panel 4 firmly against the body portion 2. Further advancement of the blank pushes the upstanding rear panel 11 of a preceeding blank downward by engagement therewith beyond the pull rolls 9 as shown in dotted lines on the left side of FIG. 3.

As previously explained, the blank continues along the conveyor 21 until its leading edge engages the stop means 12 at which time the rear panel 11 is resting on top of the second rigid folding member 10 and above the conveyor 21. The rigid folding member 10 is also a rigid beam shaped a shown in FIG. 3 and includes a down turned flange 58.

When the blank approaches the stop means 12, a conventional photocell 13 senses its position and signals the second movable folding means 42 to begin operation. The movable folding means 42 preferably includes a conventional hydraulic or pneumatic cylinder 14 mounted in fixed position by suitable hardware. The ram 60 of the cylinder is fitted with a conventional gear-tooth rack 15 which engages a similarly toothed gear wheel 16. Thus, as the ram 60 is extended by the signal from the photocell 13, the gear wheel is caused to rotate about 180°. The bore of the gear wheel 16 is secured in the usual manner to a conventional overrunning clutch 64 which is mounted upon a support shaft 62. A cam disc 17 is coupled to the output portion of the overrunning clutch so that it also rotates about 180° with the gear wheel when the rack 15 moves by extension of ram 60; however, the cam disc will not rotate in the opposite direction when the rack 15 moves upward because it is connected to the overrunning clutch 64 such that it will not do so.

The cam disc 17 includes two diametrically opposed cam lugs 18 which are arranged to abut a fixed cam stop 27 mounted to the ram 60. Thus, as the rack 15 moves downward from the position shown in FIG. 4, the bottom cam lug will rotate in a clockwise direction until it abuts cam stop 27 whereupon further rotation ceases; the cam lug 18 remains in this position until the next downward stroke of rack 15 whereupon the other cam lug 18 then in the bottom position will rotate until it reaches the cam stop 27.

A roller lever 19 is connected to the cam disc 17 so that it rotates intermittently in the same fashion as the cam disc. Rollers 20 are mounted for rotation on each end of lever 19 so that, upon rotation of lever 19, one roller 20 engages the body portion 2 of the blank adjacent the rear fold line 34 and pushes the body portion downward against the top of conveyor 21 which is situated below the rigid folding member 10. This causes the rear panel 11 to bend upward about the fold line 34 as shown by the solid lines of the panel in FIG. 4. Thereafter, the rear panel 11 is pushed forward and downward against the body portion 2 of the blank by the next advancing blank 2 as previously expalined. As the upstanding rear panel 11 is pushed downward, another photocell 26 senses the movement of the panel and sends an electric signal to the stop means 12 causing it to release the first blank for further advancement along the conveyor 21; after the rear edge of the blank passes the stop means 12, the stop means returns to a position for stopping the next succeeding blank as will be explained.

The conveyor belts 21 pass around a pair of pulleys 22 and 66 spaced in the direction of travel of the blanks, such pulleys being arranged such that the upper flight of the belt is inclined slightly upwards toward the downstream pulley 66 so that the blanks are brought into contact with the stop means 12. The upstream pulley 22 is vertically adjustable by a conventional adjustment means (not shown) to accommodate rear panels of different sizes for different sized box blanks; that is, if a rear panel is longer than the one shown in FIG. 4, the pulley 22 would be lowered to prevent interference between the top edge of the panel and roller lever 19.

Figure 5:
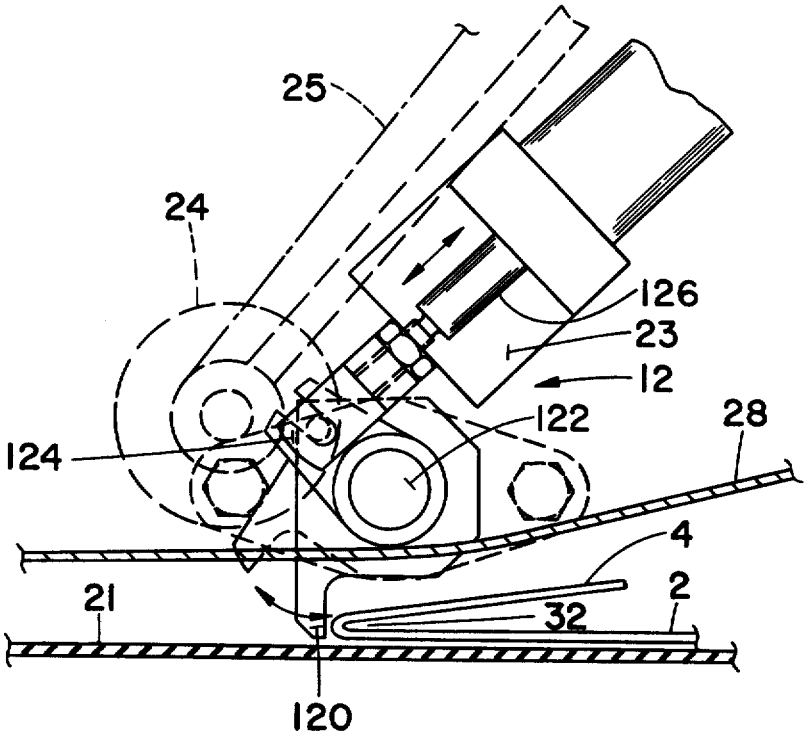
FIG. 5 is an enlarged side elevation of a portion of the apparatus taken along the lines V—V of FIG. 1 showing the arrangement for actuating the stop means used to momentarily stop the advance of a blank as its rear panel is being folded.

The stop means 12 preferably includes a gate member 120, shaped as shown in FIG. 5, secured to a pivot shaft 122. A conventional hydraulic or pneumatic cylinder 23 is connected by a conventional clevis connection 124 to the pivot shaft 122. Thus, upon extension of the rod 126 of the cylinder, the rod 122 is pivoted to rotate the gate member 120 counterclockwise into the path of an oncoming blank to stop its forward travel. Similarly, retraction of the cylinder pivots the gate member 120 in a clockwise direction and, therefore, upward to permit the stopped blank to be advanced by the conveyor belts 21. As previously explained, the photocells 13 and 26 control the timing of the stop means 21 to properly stop and release the successive blanks.

It should be appreciated that the various movable and fixed folding means and stop means need not necessarily be made exactly as shown in the drawings. For example, the first movable folding means 50 could be actuated by mechanical linkages rather than by the cylinder 6. In addition, the fingers 5 need not necessarily pivot; instead, they could be fixed in an inclined plane to guide the front panel into engagement with the folding member 8 and then be brought below the path of travel to permit the front-folded blank to pass beneath the leg 56 of member 8 and into the pull rolls 9.

The second movable folding means also need not be exactly as shown. For example, a flat plate could be attached to the end of the rod 60 for pushing the body portion 2 downward against the conveyor 21 while the blank is stopped, with the weight rollers 24 holding the blank against the conveyor, and the plate retracted before the next succeeding blank folds the rear panel over against the body portion of the blank 2.

Similarly, the stop means 12 may be operated by mechanical linkages and could also comprise a number of fingers extendable downwardly or upwardly into the path of travel of the blanks.

Although the use of photocells as sensing means for the positions of the blanks is preferred, conventional limit switches may be successfully employed for the same purpose.

In summary, it can be seen that the present invention provides a simple, effective apparatus for folding the front and rear panels of box blanks without the need for extensive adjustment to accommodate blanks and panels of different sizes and especially without the need for complex folding hooks and the like. In addition, the front and rear panels of the blanks are folded to be in satisfactory condition for folding of the side panels by subsequent folding machinery.

Thus, the invention having been described in its best embodiment and mode of operation, that which is desired to be claimed by Letters Patent is:

1. Apparatus for folding the front and rear panels of a succession of advancing box blanks comprising:

first pull roll means for serially advancing said blanks, first moveable folding means downstream from said first pull roll means for partially folding said front panel upwardly along a front transverse score line in each of said blanks succeedingly engaging said first moveably folding means;

drive means for moving said first moveable folding means into operable contact with said front panel;

sensing means adapted to sense the position of said advancing blanks, and provide a signal for actuating said drive means for moving said first moveable folding means into operable contact with said front panel of said advancing blanks;

a first rigid folding member downstream from said first moveable folding means for engaging the partially folded front panel and bending it further toward the body portion of the blank being folded, said first pull roll means continuing to advance said blank;

second pull roll means downstream from said first rigid folding member for continuing advancement of each successive blank and for pressing said first panel firmly against the body portion of said blank;

stop means downstream from said second pull roll means for temporarily stopping the advance of each succeeding blank by engaging the fold line along which said first panel is folded;

drive means for moving said stop means into and out of engagement with said stop means;

second sensing means adapted to sense the position of an advancing blank and provide a signal to said drive means to move said stop means into engagement with said blank;

a second rigid folding member adjacent the downstream side of said second pull roll means for supporting the unfolded rear panel of a blank, stopped by said stop means, above an endless conveyor means positioned below said second rigid folding member;

second moveable folding means engageable with the body portion of the blank having its rear panel supported by said rigid folding member adjacent a rear transverse score line in said blank, for urging said body portion against said conveyor means to fold said rear panel upwardly by virtue of its engagement with said second rigid folding member, said rear panel being folded forward and downward against the body portion of said blank by the advance of the next succeeding blank engaging the upwardly folded rear panel ; and third sensing means adapted to sense the folding of said rear panel of said blank engaged by said stop means and provide a signal to move said stop means out of engagement with said blank.

2. The apparatus of claim 1 wherein said first movable folding means comprises:

a plurality of pivotable finger members movable into an inclined position for guiding the front panel of an advancing blank into engagement with said first rigid folding member and movable out of the path of advance of said first panel to permit continuous advance of said blank.

3. The apparatus of claim 2 further including:

fluid operated drive means for pivoting said finger members.

4. The apparatus of claim 1 wherein said first rigid folding member comprises:

a rigid beam member engageable with an inclined front panel of an advancing blank and having an inclined lower portion for folding said front panel backward and downward against a body portion of said blank.

5. The apparatus of claim 1 wherein said stop means comprises:

a pivotable gate member movable into the path of advance of an advancing blank having its front panel previously folded for stopping the advance thereof and movable out of said path of advance to permit continued advancement of said blank along said endless conveyor means.

6. The apparatus of claim 5 further including:

fluid operated drive means for pivoting said gate member.

7. The apparatus of claim 1 wherein said second folding member comprises:

a rigid beam member for supporting the rear panel of a blank stopped by said stop means, said beam member having a substantially horizontally extending portion extending downstream from said second pull roll means and terminating in a down turned flange portion.

8. The apparatus of claim 1 wherein said second movable folding means comprises:

rotatable lever means movable into engagement with the body portion of a blank supported by said second rigid folding means adjacent a fold line in said blank for urging said body portion downward to fold said rear panel upwardly about said fold line.

9. The apparatus of claim 8 further including:

fluid operated drive means for rotating said rotatable lever means into and out of engagement with said body portion of said blank.

10. The apparatus of claim 9 further including:

sensing means for sensing stoppage of a blank by said stop means and to provide a signal to said fluid operated drive means for rotating said rotatable lever.

11. The apparatus of claim 10 further including:

toothed rack and gear means, operable through an overrunning clutch means, for rotating said lever means intermittenly to bring first and second portions thereof into engagement with alternate ones of said succeeding blanks and further including cam means for controlling intermittent rotation of said lever means.

* * * * *